US005241849A

United States Patent [19]

Baur

[11] Patent Number: 5,241,849

[45] Date of Patent: Sep. 7, 1993

[54] DRAWING APPARATUS IN THE BEDPLATE OF A PRESS

[75] Inventor: Siegfried Baur, Göppingen, Fed. Rep. of Germany

[73] Assignee: L. Schuler GmbH, Fed. Rep. of Germany

[21] Appl. No.: 868,227

[22] Filed: Apr. 14, 1992

[30] Foreign Application Priority Data

Apr. 20, 1991 [DE] Fed. Rep. of Germany ..... 4112943

[51] Int. Cl.[5] ..... B21D 24/08

[52] U.S. Cl. ..... 72/351; 72/345

[58] Field of Search ..... 72/350, 351, 345, 453.13; 267/119

[56] References Cited

U.S. PATENT DOCUMENTS

| | | | |
|---|---|---|---|
| 1,503,131 | 7/1924 | Nelson | 267/119 |
| 1,970,134 | 8/1934 | Ferris | 267/119 |
| 2,233,164 | 2/1941 | Glasner | 267/119 |
| 4,601,190 | 7/1986 | Schneider et al. . | |
| 4,745,792 | 5/1988 | Story et al. | 72/351 |

FOREIGN PATENT DOCUMENTS

| | | | |
|---|---|---|---|
| 401534 | 12/1990 | European Pat. Off. | 72/351 |
| 3717768 | 12/1988 | Fed. Rep. of Germany . | |
| 3807683 | 9/1989 | Fed. Rep. of Germany . | |
| 1481202 | 7/1977 | United Kingdom . | |
| 2115734 | 9/1983 | United Kingdom . | |

*Primary Examiner*—Lowell A. Larson

*Attorney, Agent, or Firm*—Evenson, McKeown, Edwards & Lenahan

[57] ABSTRACT

A drawing apparatus pressure pins acting upon the metal sheet holder in the bottom part of the tool are selected, has additional pressure cylinders fastened in the pressure cheek between the actual drawing apparatus acting upon a pressure cheek and the pressure pins. These additional pressure cylinders are individually controllable via valves from a pressure pipe. As a result, a precise influence is made on the drawing conditions of various sheet metal parts and their ejector movement from the bottom part of the tool.

6 Claims, 5 Drawing Sheets

DRAWING APPARATUS IN THE BEDPLATE OF A PRESS

BACKGROUND AND SUMMARY OF THE INVENTION

This invention relates to a drawing apparatus in the bedplate of a press comprising a pressure cheek which, during the forming of sheet metal parts, can be acted upon in a liftable manner by drawing cylinders against the drawing force of the press slide and for the ejecting of the sheet metal parts from the bottom part of the tool. This apparatus comprises pressure pins between the pressure cheek and a metal sheet holder of the bottom part of the tool for the transmission of drawing and ejector movements and forces.

In order to form deep-drawn pieces in a press, it is necessary to hold the metal sheet or the preform which was inserted into the tool and, by means of a yielding cushion, allow a counterforce ("drawing force") to act against the force caused during the downstroke of a slide of the press. During the drawing operation, the sheet metal part is held between a metal sheet holder in the bottom part of the tool and a counter contact in the top part of the tool.

In the German Patent Document DE 32 02 134 C1, a drawing apparatus for a press was described which comprises a pressure cheek that can be lifted and lowered in the bedplate of the press. The pressure cheek is situated below a holding plate for the bottom part of the tool and is supported in a pressure cylinder fixed to the bedplate of the press. By means of the pressure cheek, a number of pressure cylinders can be moved with respect to their height and act upon ejector pins in the bottom part of the tool by way of a pin plate. As a result of the force of the slide, the pressure cheek is lowered during the drawing operation by way of the pin plate and the ejector pins. After the drawing operation, the pistons of the pressure cylinders are acted upon, in the sense of an ejecting movement for the formed part with a slight pressure which is equal for all pressure cylinders, while the pressure cheek is still held in the lower position. The pressure cheek follows in a delayed manner in order to act upon the pin plate at the start of the next drawing operation.

In addition, a drawing apparatus in a press is known from the European Patent Document EP 0 173 755 A1 in which the metal sheet holder pressure is to be adapted in the different contact pressure ranges for the deep-drawn part. For this purpose, a number of pressure cylinders are used which are fixedly installed in the bedplate of the press and the piston rods of which can be moved with respect to their height by way of a pressure cheek which acts jointly on all piston rods. The piston rods which act on the metal sheet holder at the other end, during the slide movement, can be lowered below the pressure which can be variably controlled via valves in the pressure chambers.

In the German Patent Document 37 17 768 A1, a drawing apparatus in the bedplate of a press was described in which the drawing and the ejecting of the sheet metal parts is to take place either by means of metal sheet holders or by means of a drawing die. A change of the operating method is required for this purpose. In the drawing apparatus, a pressure cheek is acted upon by drawing cylinders by way of a liftable and lowerable carriage. For this purpose, pressure rods are fixedly disposed in the carriage in the extension of the piston rods of the drawing cylinders. The pressure rods are moved out by the pressure cheek in order to rest against the metal sheet holder. Mechanical couplings for the selective uncoupling and coupling of the drawing apparatus and the ejector apparatus from and to the pressure cheek are arranged between the pressure cheek and each of the pressure rods and between the pressure cheek and the lengthened piston rod of the ejector apparatus.

Similar to these previously known drawing apparatuses are those which have a number of pressure pins that only become active together or act upon a metal sheet holder while they are acted upon by drawing cylinders. The number of drawing cylinders is lower than the number of pressure pins, however, without the possibility of carrying out a selection of pressure pins to be acted upon.

An object of the invention is to provide an apparatus which enables selection of the pressure pins acting upon the metal sheet holder in order to hereby fulfill the requirements concerning the size of a sheet metal part, its shape and the free forms and to obtain, for example, also mirror-symmetrical sheet metal parts. Another object of the invention is to provide apparatus which, by the selection of specific pressure pins and correspondingly fewer controlled drawing cylinders, carries out the ejector operation with less energy, while the drawing cylinders which are not controlled during the ejector operation are controlled in a later phase.

This object is achieved by the present invention which provides a drawing apparatus in a bedplate of a press that has top and bottom tool parts and a press slide, the bottom tool part having a metal sheet holder. The drawing apparatus comprises drawing cylinders and a pressure cheek which, during the forming of sheet metal parts, can be acted upon in a liftable manner by the drawing cylinders against a drawing force of the press slide and for ejecting the sheet metal parts from the bottom tool part. Pressure pins are arranged between the pressure cheek and the metal sheet holder of the bottom tool part for transmitting drawing and ejector movements and forces. Pressure cylinders are disposed in the pressure cheek, the number of pressure cylinders being equal to the number of pressure pins, each pressure cylinder having a pressure cylinder piston rod. The pressure cylinders are arranged in a vertical course with the same axis with respect to a corresponding one of the pressure pins and has piston surfaces which are acted upon from the bottom by pressure so as to cause each of the pressure cylinder piston rods to contact the corresponding pressure pin from below.

An advantage of the present invention is that the metal sheet holding operation during the drawing as well as the ejector operation is influenced by the fact that the pressure cylinders in the pressure cheek are selectively controlled, whether acted upon or not acted upon. The drawing may take place with a lower number of drawing cylinders while the individual drawing force in each case is higher and the selective control of pressure pins is utilized. At the same time, the individual drawing force and therefore the dimensioning of each of the drawing cylinders is determined to be lower.

In certain embodiments of the invention, not only a reduction of the overall pipe cross-section to the valves is achieved, but also elasticities of the circuit structure are significantly reduced. This is due to the reduction of the distances between the respective pressure space of a pressure cylinder and the pertaining on-off valve.

Other objects, advantages and novel features of the present invention will become apparent from the following detailed description of the invention when considered in conjunction with the accompanying drawings.

DETAILED DESCRIPTION OF THE DRAWINGS

Figure 1:
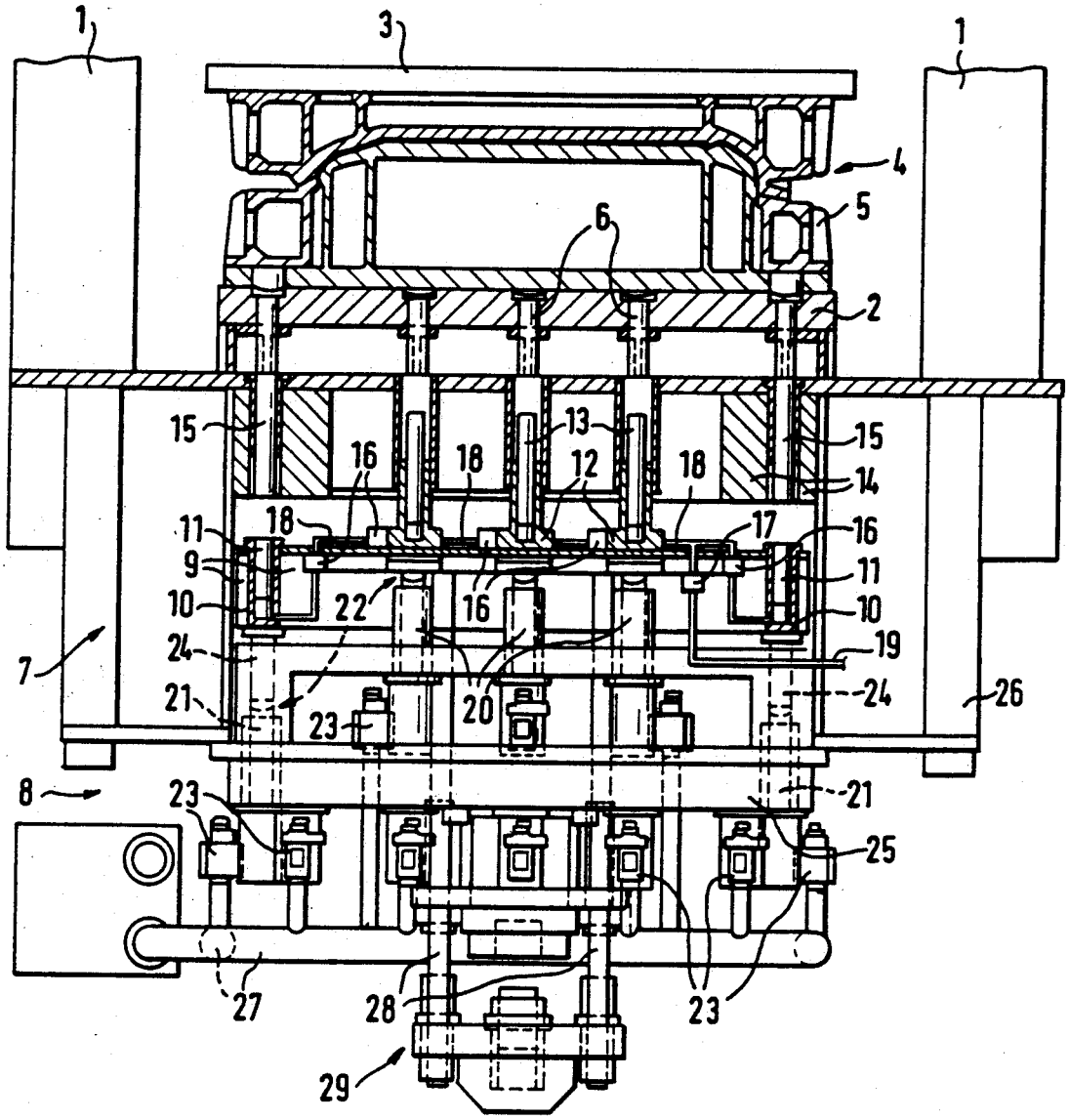
FIG. 1 is a partial sectional representation of a press comprising a drawing apparatus constructed in accordance with an embodiment of the present invention.

In FIGS. 1, 2 and 4, 5, the press stands of a press have the reference number 1, a bedplate of the press ha the reference number 7, and the drawing apparatus for the forming and the ejection of the sheet metal parts 30 has the reference number 8. A sliding table 2 which can be moved into the press has pressure pins 6 which can be moved in receiving holes in the sliding table 2. A tool comprising a top part 3 and a bottom part 4 for a sheet metal part or a set of tools for the simultaneous forming of several sheet metal parts is placed on the sliding table 2. In addition to a male mold or parts of a male mold which may also be parts of a female mold, the bottom part 4 of the tool also comprises a metal sheet holder 5 for the holding of the outer and inner edge areas of the sheet metal parts during the downstroke of the slide of the press and of the top part 3 of the tool which is then attached to the slide. The metal sheet holder can be acted upon by the pressure pins 6.

For the purpose of generating the drawing forces and the metal sheet holder forces and of the movements required for this purpose, the drawing apparatus comprises drawing cylinders 20 and 21 which, by way of a traverse 25 which is held on press stand plates, are fixedly mounted on the press. The drawing cylinders 20, for reasons of space, are arranged higher than drawing cylinders 21. As described in, for example, the European Patent Document EP 0 173 755 B1, the drawing cylinders 20, 21 can be controlled by way of valves 23 from a pressure supply system 27. Via the piston rods and pressure pins 24 belonging to the cylinders, the drawing cylinders 21 act indirectly and drawing cylinders 20 act directly on a pressure cheek arranged in a liftable and lowerable manner in the bedplate, in areas in which pressure cylinders 10, 12 with piston rods 11, 13 are mounted. By way of valves 16, these pressure cylinders 10, 12 can be controlled from a pressure pipe 18, 19. A valve 16 is connected to each pressure cylinder 10, 12, the valves 16 and the pressure lines 18 also being fastened to a pressure cheek 9. Only the pipe part having the reference number 19 is a movable pipe and for this purpose is connected via a connecting block 17.

By means of the selective control of the valves 16, the pressure cylinders 10, 12 may correspondingly be controlled individually. The piston rod 11 is moved out of the pressure cylinders 10 by the bottom side of the pertaining piston 11 being acted upon by pressure. The piston rods 11, via control of the pressure cylinders 10, indirectly act upon pressure pins 6 in the sliding table 2 via pressure pins 15. On the other hand, by control of the pressure cylinders 12, the piston rods 13 act directly on the pressure pins 6 in the sliding table 2. By means of this type of a discrete control of the pressure cylinders 10, 12 in the pressure cheek 9, the drawing conditions of sheet metal parts 30 of different types can be taken into account during the forming, as shown in FIG. 3, and also those with more or less large recesses.

For the movable bearing of the pressure pins 15 and for the guiding-through of the piston rods 13 for the engagement with the pressure pins 6, the bedplate 7 has an apertured plate 14 with corresponding openings. For the discrete control of the drawing cylinders 20, 21, a lifting of the pressure cheek 9 from the piston rods of the drawing cylinders 20, 21 is required. For this purpose, elements which can be uncoupled from one another, such as ball sockets 22, are provided between the piston rods of drawing cylinders 21 and the pressure pins 24, and between the piston rods of drawing cylinders 20 and the pressure cheek 9.

Figure 2:
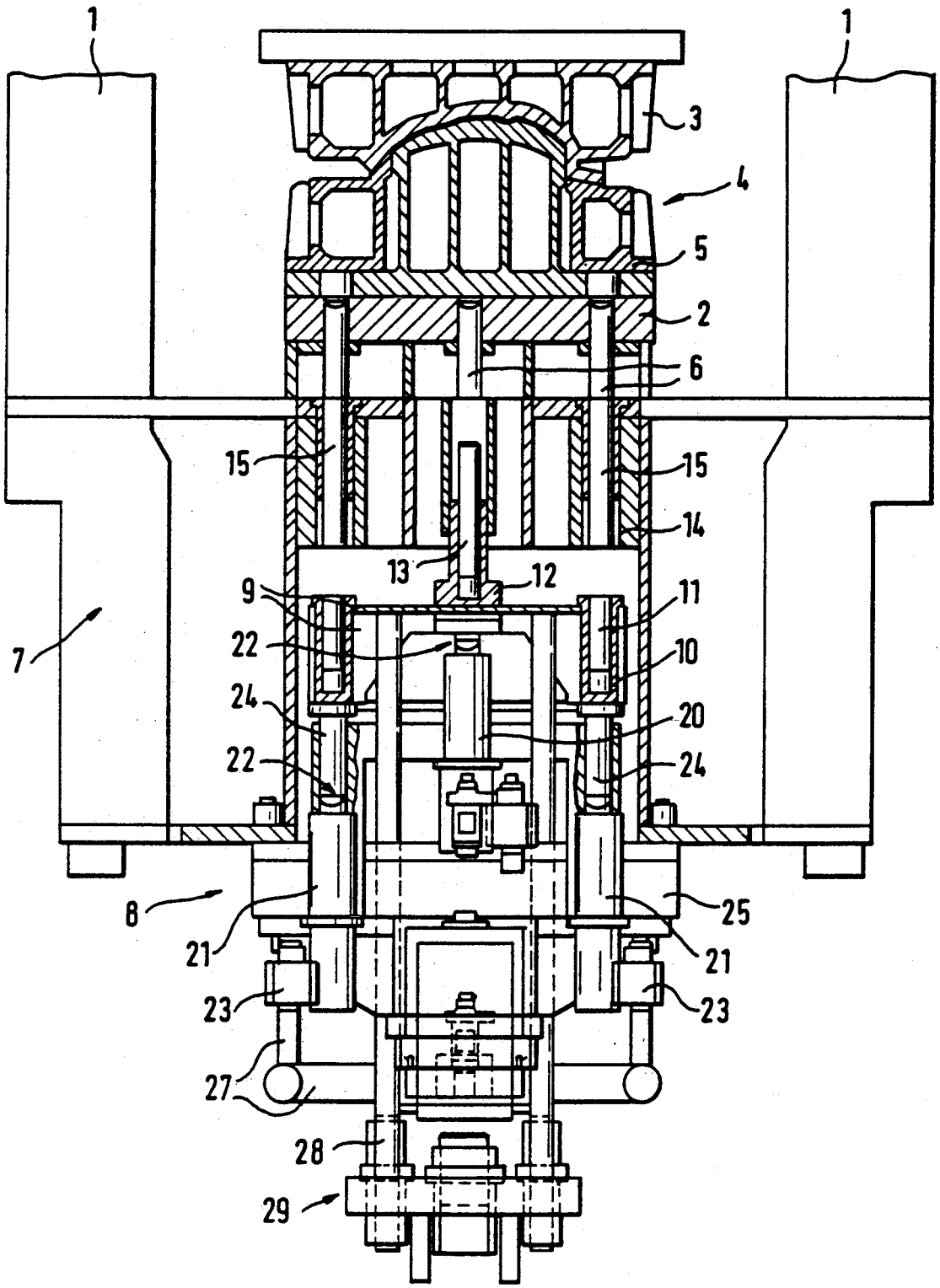
FIG. 2 is a partial sectional representation of a lateral view with respect to FIG. 1.

FIGS. 1 and 2 show the point in time of, for example, the setting of the press, in which case the top part 3 of the tool must still be fastened to the press slide. None of the drawing cylinders 20, 21 are acted upon by pressure. The freedom of motion of the pressure cheek 9 can be changed by means of the adjustment of the stop device 29. The stop device 29 is fastened to the pressure cheek 9 by spacing pins 28.

Figure 3:
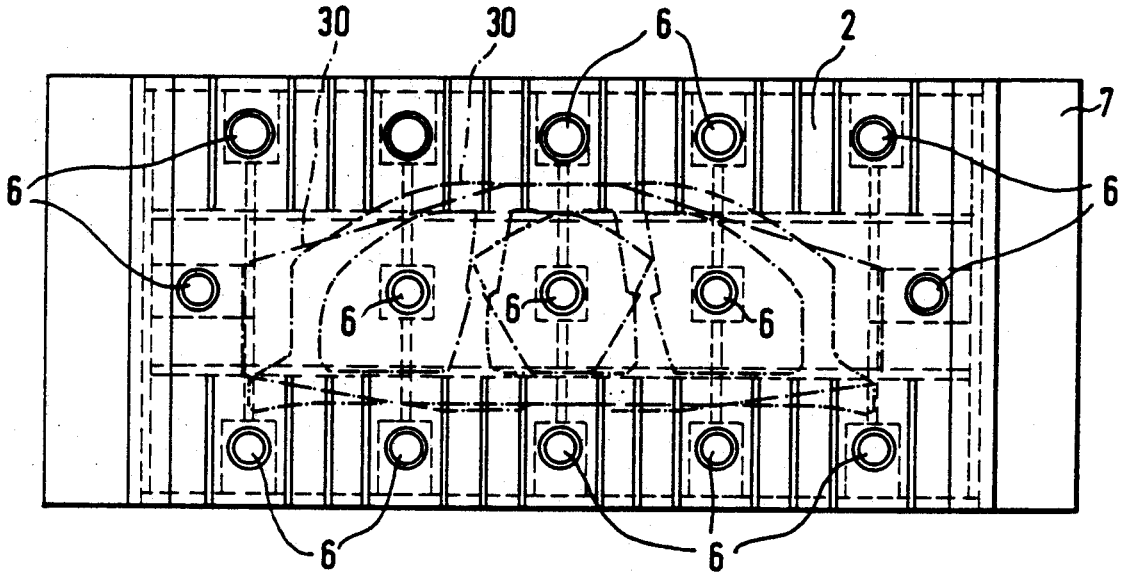
FIG. 3 is a top view of the sliding table.

FIG. 3 illustrates only the top side of the sliding table 2 which is situated on the bedplate 7 and has a hole pattern for the passing-through and the bearing of pressure pins 6. Sheet metal parts of various shapes used as examples have the reference number 30 in order to stress the significance of the different action on the pressure pins 6 by means of the above-discussed devices of the drawing apparatus.

Figure 4:
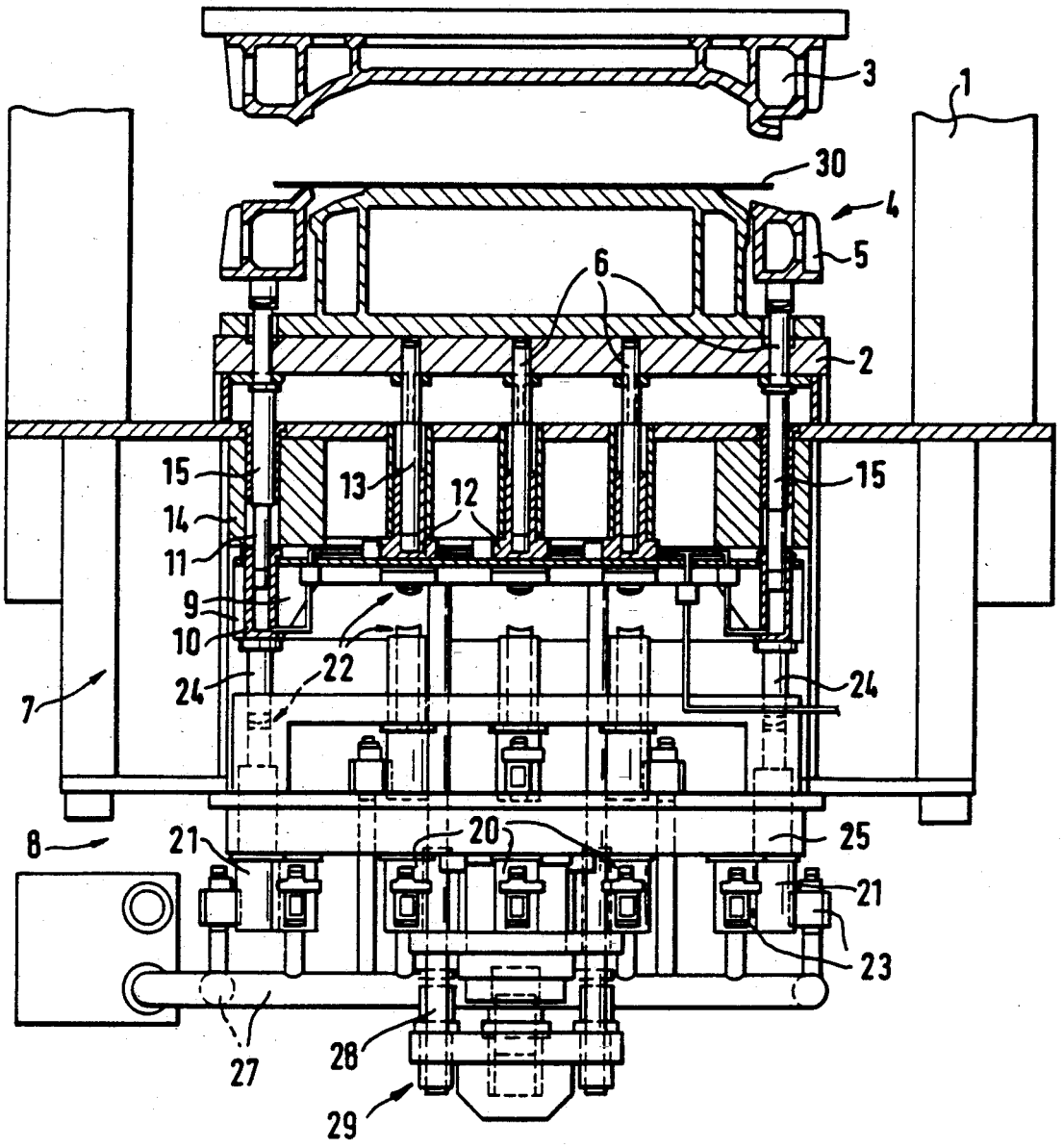
FIG. 4 is a representation corresponding to FIG. 1 with several activated pressure cylinders in the pressure cheek.
Figure 5:
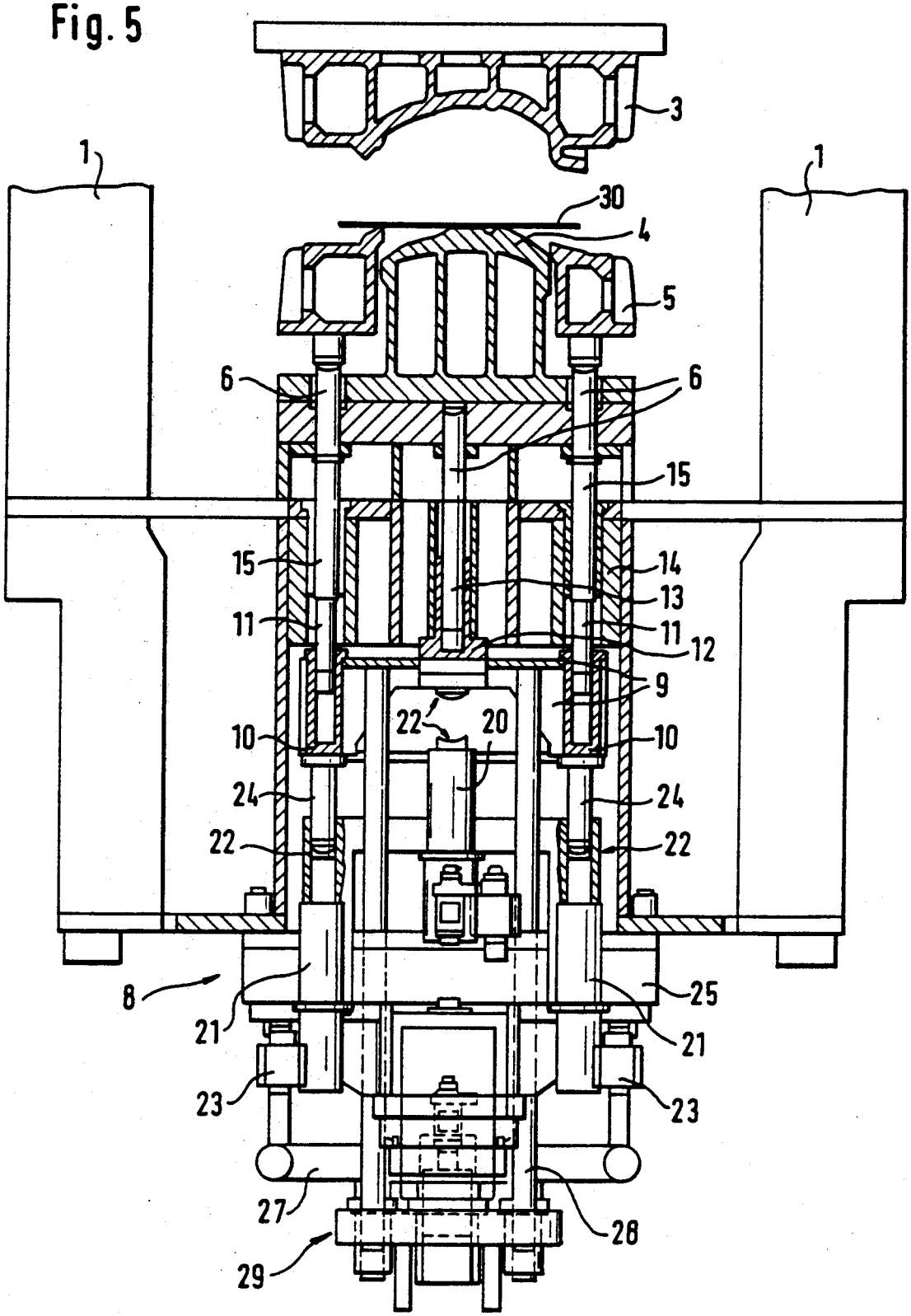
FIG. 5 is a lateral view corresponding to FIG. 4.

In FIGS. 4 and 5, the top part 3 of the tool is shown lifted off the bottom part 4 of the tool by means of a slide of the press. For holding the inserted metal sheet or sheet metal part 30, drawing cylinders 21 have been acted upon which are situated only on the outside. The lifted pressure cheek 9 has lifted off the piston rods of the drawing cylinders 20 situated on the inside. Together with the drawing cylinders 21 and 20, the pressure cylinders 10 are correspondingly also acted upon by pressure via the valves 16, the piston rods 15 of which have moved out and are in operative engagement with the pressure pins 6 situated above. During the forming operation, the metal sheet holder 5 is therefore acted upon only by the selected units. The drawing pressure as well as the required movements which essentially and at first with the downstroke of the slide are lowering movements of the pressure cheek 9, is applied by the drawing cylinders situated underneath, here, for example, 21. Naturally, also additional drawing cylinders or generally different drawing cylinders can be controlled and act upon the pressure cheek 9. The selecting of the pressure pins 6 for the acting-upon of the metal sheet holder 5 or of several metal sheet holders, takes place via the controlled pressure cylinders 10, 12 of the pressure cheek 9.

In the same manner, for the ejector movement of the formed sheet metal parts 30 from the bottom part 4 of the tool by means of a metal sheet holder or drawing die, a corresponding control of individual drawing cylinders 20, 21 and of individual pressure cylinders 10, 12 may take place, particularly with a view to a synchronizing control during the ejector movement of the pressure cheek.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A drawing apparatus in a bedplate of a press that has top and bottom tool parts and a press slide, the bottom tool part having a metal sheet holder, the drawings apparatus comprising:

drawing cylinders;

a pressure cheek which, during the forming of sheet metal parts, can be acted upon in a liftable manner by said drawing cylinders against a drawing force of the press slide and for ejecting the sheet metal parts from the bottom tool part;

pressure pins between the pressure cheek and the metal sheet holder of the bottom tool part, said pressure pins transmitting both drawing and ejector movements and forces;

individually actuatable pressure cylinders disposed in the pressure cheek, the number of pressure cylinders being equal to the number of pressure pins, each said pressure cylinder having a pressures cylinder piston rod, said pressure cylinders being arranged in a vertical course with the same axis with respect to a corresponding one of said pressure pins and having piston surfaces which are acted upon from the bottom by pressure so as to cause each of said pressure cylinder piston rods to contact the corresponding pressure pin from below.

2. The drawing apparatus of claim 1, wherein the number of drawing cylinders are equal to the number of pressure pins, each said drawing cylinder having a piston rod, said drawing cylinders being arranged in a vertical course with the same axis with respect to a corresponding one of said pressure pins, said drawing cylinder piston rods being acted upon from the bottom by pressure so as to cause said drawing cylinder piston rods to be placed from below against the pressure cheek in the area of the pressure cylinders and are also separable from the pressure cheek.

3. A drawing apparatus according to claim 2, further comprising a common pressure pipe to which the pressure cylinders are connected, and an on/off valve is connected in the pipe to each of the pressure cylinders, for a selective application of pressure into the pressure cylinders.

4. A drawing apparatus according to claim 3, wherein the valves for the selective application of pressure into the pressure cylinders are mounted at the pressure cheek.

5. A drawing apparatus according to claim 1, further comprising a common pressure pipe to which the pressure cylinders are connected, and an on/off valve is connected in the pipe to each of the pressure cylinders, for a selective application of pressure into the pressure cylinders.

6. A drawing apparatus according to claim 5, wherein the valves for the selective application of pressure into the pressure cylinders are mounted at the pressure cheek.

* * * * *